United States Patent [19]

Sittmann

[11] 3,950,000

[45] Apr. 13, 1976

[54] DEVICE IN SKI BINDINGS WITH PIVOTAL SOLE SUPPORT

[75] Inventor: Brigitte Sittmann, Stuttgart, Germany

[73] Assignee: Vereinigte Baubeschlagfabriken Gretsch and Co. GmbH, Germany

[22] Filed: Dec. 3, 1973

[21] Appl. No.: 421,349

[30] Foreign Application Priority Data

Dec. 1, 1972 Germany ..... 2258905
June 29, 1973 Germany ..... 2333166

[52] U.S. Cl. ..... 280/11.35 C
[51] Int. Cl.[2] ..... A63C 9/00
[58] Field of Search 280/11.35 C, 11.35 R, 11.35 H, 280/11.35 K, 11.35 D

[56] References Cited

UNITED STATES PATENTS

| | | | |
|---|---|---|---|
| 3,219,359 | 11/1965 | Schneider | 280/11.35 R |
| 3,244,431 | 4/1966 | Hatlapa | 280/11.35 K |
| 3,544,123 | 12/1970 | Werner et al. | 280/11.35 C |
| 3,618,965 | 11/1971 | Hecker | 280/11.35 C |

FOREIGN PATENTS OR APPLICATIONS

| | | | |
|---|---|---|---|
| 268,118 | 1/1969 | Austria | 280/11.35 Y |
| 230,240 | 11/1963 | Austria | 280/11.35 K |

*Primary Examiner*—Robert R. Song
*Assistant Examiner*—Milton L. Smith
*Attorney, Agent, or Firm*—Craig & Antonelli

[57] ABSTRACT

Ski binding apparatus which has a sole support pivotal about a pivot axis extending substantially perpendicular to the ski surface and secured against axial lifting off from the ski, in which the sole support is axially secured by readily detachable securing means. In preferred embodiments the readily detachable securing means are in the form of two-part snap action connection means which automatically connect and disconnect the sole support in response to forces on the two parts in the direction of the pivot axis. In other preferred embodiments, the securing means include spring detents engageable with aperture means in a pivot pin for the sole support.

61 Claims, 9 Drawing Figures

DEVICE IN SKI BINDINGS WITH PIVOTAL SOLE SUPPORT

BACKGROUND AND SUMMARY OF THE INVENTION

The present invention relates to ski binding apparatus with a sole support pivotal about a pivot axis disposed approximately perpendicularly to the ski surface. The present invention is more particularly related to apparatus for securing such sole support against a lifting off from the ski.

Such sole supports mounted on the ski are intended to reduce the friction occurring between the ski boot and the ski during a release operation. The sole supports may have different shapes, however, they are preferably constructed disk-shaped and are rotatably riveted or screwed to a plate for purposes of fastening at the ski. In previously contemplated arrangements, disk-shaped sole supports are rotatably secured to a plate by means of a screw nut accessible when the plate is screwed onto the ski.

In practice, however, it has been found that dirt enters between the sole support and the plate during use, which dirt reduces the easy movability of the sole support and finally blocks the same. The sole support then has to be cleaned again and be provided with lubricant. If the sole support is riveted on, removal for cleaning is not possible. If the sole support is screwed on, then it has to be removed by means of a screw driver. In order to be able to clean the sole support of the type of construction of the above-mentioned previously contemplated arrangements, the plate has to be removed at first from the ski since the head of the screw retaining the sole support is accessible only from the underside of the plate. The excessively frequent required unscrewing of the plate from the ski additionally impairs the durability and life of this threaded connection.

The present invention is therefore concerned with the task to so improve the connecting arrangement sole support described that it can be cleaned in a simple manner.

The present invention contemplates overcoming the above-mentioned problems by providing that the sole support includes axially securing readily detachable securing means so that the sole support can be readily removed from the ski, preferably without the assist of tools.

In preferred embodiments of the present invention, a snap-action or snap-button fastener connection is provided as securing means, which connection also defines the pivot support or pivot axis for the sole support. Such a connection, on the one hand, pivotally secures or fastens the sole support but, on the other hand, can be removed by a simple pulling movement in the direction of the pivot axis. No tool is necessary for the removal since no threaded connection whatsoever has to be disconnected for the removal. A jammed or blocked sole support can thus be rendered operable again in case of emergency also on the ski slopes.

One advantageous embodiment of the present invention provides that a plate is secured on the ski as base support for the sole support which consists at least within the area of the pivot axis of the sole support of a conventional material offering a tenacious elasticity and includes therein an undercut aperture or recess for the accommodation of an enlarged push-button or snap-button portion to be forced into the aperture by a bolt defining the pivot axis of the sole support and fastened to the sole support. This embodiment is characterized by particular simplicity in that no additional clamping springs or the like are required. The bolt can be pressed or riveted into the sole support. The bolt is preferably so constructed that it includes a ring shoulder which abuts the underside of the sole support, and is provided with a head portion whose upper boundary surface is flush with the top side of the sole support or lies below the surface of the sole support. Such a bolt can be permanently connected with the sole support. During the disengagement of the snap-button connection, the head portion absorbs the tensional forces and during closing of the snap-button connection, the forces applied thereby act on the annular shoulder. Since the head portion does not project beyond the top side of the sole support, it does not impair the ski boot during the release operation of the safety binding.

Another advantageous feature of the above-mentioned preferred embodiment provides that the snap-button portion to be forced into the aperture includes two conical sections coaxial to the axis of the bolt and diverging with respect to one another between which is disposed a cylindrical section. Such conical sections can be readily manufactured whereby the angle of inclination thereof predetermines the force necessary for opening and closing the snap-button connection. The cylindrical section disposed between the conical sections prevents the wear of the aperture when the snap-button portion is inserted or pulled out.

Apertures or recesses whose angle of undercut is equal to the cone angle of the conical section to be engaged by the undercut are subjected to lesser wear by reason in particular of the larger contact surfaces.

In another preferred embodiment, an insert element, especially in the shape of a U-shaped spring, is additionally provided as securing means against a lifting off of the sole support. Such an insert element can be pulled out laterally either completely or partially in a simple manner for unlocking purposes or can be inserted for locking purposes.

The use of such a spring has at the same time the advantage that the spring is usable as return spring in order to return the sole support into its center position. This is, in particular, of importance also when a sole plate pivotal on the ski is provided and the sole support is rotatably supported on the sole plate as a rotatable disk. The rotatable disk is thereby able to follow the ski boot as regards its angular position during a lateral deflection of the ski boot by a corresponding pivoting of the sole plate, which is pivotally supported on the ski, for example, in front of the pivot pin of the pivot disk serving for the support of the forward boot portion, whereby the release resistance is reduced and the safety for an orderly release of the binding is increased. With the hitherto customary devices of this type, it was necessary to return the sole plate again into its prescribed center position for the re-engagement of the binding.

In a particularly preferred simple embodiment of the invention, the return spring engages the pivot pin of the pivot disk. Advantageously, the return spring is formed by a U-shaped spring fastened laterally on the ski whose free leg is coupled with the sole plate, especially by means of the pivot pin of the rotatable disk. A particularly simple construction results thereby if the U-spring is supported with prestress on the pivot pin of the sole plate and on a further pin fixed on the ski and arranged preferably between the pivot pin of the sole plate and the pivot pin of the rotatable disk, which spring engages on both sides the two first-mentioned pins as also the further pin.

For the purpose of a further reduction of the friction, the pivotal sole plate is, according to another preferred embodiment of the invention, slidingly supported on a bottom plate fixed on the ski under interposition of a low friction layer, for example, of low friction laminated metal plates having low friction material embedded therein, hereinafter referred to as low friction plates, whereas the return spring is arranged in an aperture or recess of this layer. The plates forming this layer may thereby be inserted, separated into individual disks, loosely into apertures which are formed by the bottom plate or by retaining plates securely connected therewith. A further considerable reduction of the friction results additionally if the rotatable plate is rotatably supported on the pivotal sole plate by interposition of a further low friction layer, especially of "TEFLON" (polytetrafluoroethylene).

These and further objects, features and advantages of the present invention will become more apparent from the following description when taken in connection with the accompanying drawing which shows, for purposes of illustration only, several embodiments in accordance with the present invention.

DETAILED DESCRIPTION OF THE DRAWINGS

Figure 1:
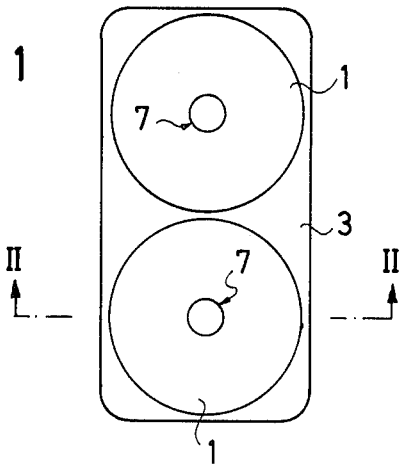
FIG. 1 is a plan view of safety ski binding apparatus including a pivotal sole support with a snap-button connection in accordance with a first embodiment of the present invention.

Referring now to the drawing wherein like reference numerals are used throughout the various views to designate like parts, and more particularly to FIG. 1, this figure illustrates a sole support installation. It includes as sole support two circularly shaped disks 1 arranged adjacent one another which are rotatably supported on a plate 3. The plate 3 is adapted to be secured with its side opposite the disks 1 on the top side of the ski, for example, by an adhesive connection utilizing conventional bonding means or by a threaded connection. The disks 1 should thereby be arranged transversely to the longitudinal direction of the ski.

Figure 2:
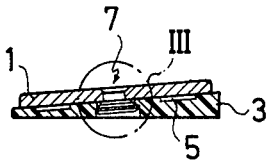
FIG. 2 is a partial cross-sectional view, taken along line II—II of FIG. 1.

FIG. 2 illustrates a cross section through the sole support installation according to FIG. 1. The plate 3 is constructed wedge-shaped so that the sole bottom side of a ski boot abuts only at the highest areas of the disks 1. The ski boot is thereby able to deflect out of the longitudinal direction of the ski with very low friction after the release of the safety binding in spite of the fact that its sole bottom side is braked by the areas of the disk 1 rotating in the opposite direction. However, it is necessary for the completely satisfactory operation of the safety binding that the disks 1 can rotate very easily with respect to the plate 3. Consequently, a lubricant is applied advantageously between the disks 1 and the plate 3. Appropriate ring-shaped lubricating grooves 5 (FIG. 2) are therefore arranged about the axes of the disks 1.

Figure 3:
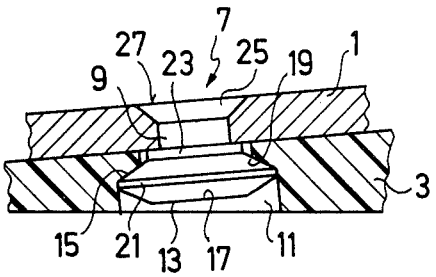
FIG. 3 is a partial cross-sectional view, on an enlarged scale, illustrating certain details of FIG. 2.

For purposes of cleaning the intermediate space between the disks 1 and the plate 3 and/or for refilling of the lubricant in the lubricant grooves 5, the disks 1 are rotatably supported by a snap-button connection generally designated by reference numeral 7. The disks 1 can therefore be pulled off in the direction of their axes. No tool is required for the removal of the disks 1, it only being necessary to apply sufficient axial forces to the disks and plate 3 to separate same from the snap connection. Details of the snap-button connection 7 are best shown in FIG. 3. The disk 1 is retained by a bolt 9 defining the pivot for and extending along the pivot axis of the disk 1. The end of the bolt 9 opposite the disk 1 is provided with an enlarged snapbutton portion 13 which engages behind an undercut 15 in an aperture 11 of the plate 3. The snap-button portion 13 includes two conical sections 17 and 19 coaxial to the axis of the bolt 9 and diverging or opening with respect to each other to accommodate insertion and retraction of bolt 9 from aperture 11. The angle of undercut 15 of the aperture 11 is equal to the cone angle of the cone section 19 to be engaged by the undercut 15.

The plate 3 consists in the illustrated embodiment uniformly of a material having a tenacious elasticity. Any conventional material offering this property can be used for the present invention. Specific preferred materials for the plate 3 include hard rubber and synthetic resinous materials including polyamides. However, it is also within the scope of the present invention to provide only the area about the aperture 11 of such tenacious elastic material. For purposes of improving the clamping action of the undercut 15, the latter may also be provided with radial slots (not illustrated). The present invention also contemplates non-illustrated embodiments similar to the one of FIG. 3 but with the bolt fastened to the plate and the aperture in the disk.

It is prevented by an appropriate construction of the bolt 9 that the bolt is removed from the disk 1 during the pulling off of disk 1 from plate 3. To that end, the bolt 9 includes an annular or ring shoulder 23 which abuts the bottom side of the disk 1. The ring shoulder 23 absorbs the pressure forces acting on the disk 1 during the closing of the snap-button connection 7, i.e., during the insertion of the snap button head portion 13 into the aperture 11. On the other hand, bolt 9 is provided with a head portion 25 whose upper boundary surface 27 is flush with the top side of the disk 1. The head portion 25 absorbs during the disconnection of the snap-button connection 7 the tensional forces acting on the disk 1.

Figure 5:
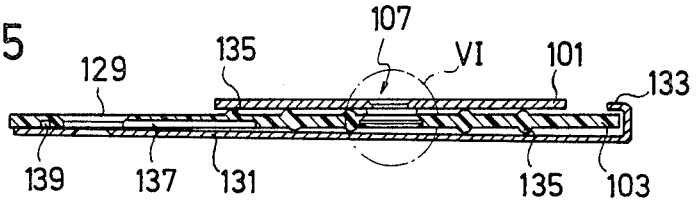
FIG. 5 is a cross-sectional view taken along line V—V of FIG. 4.
Figure 4:
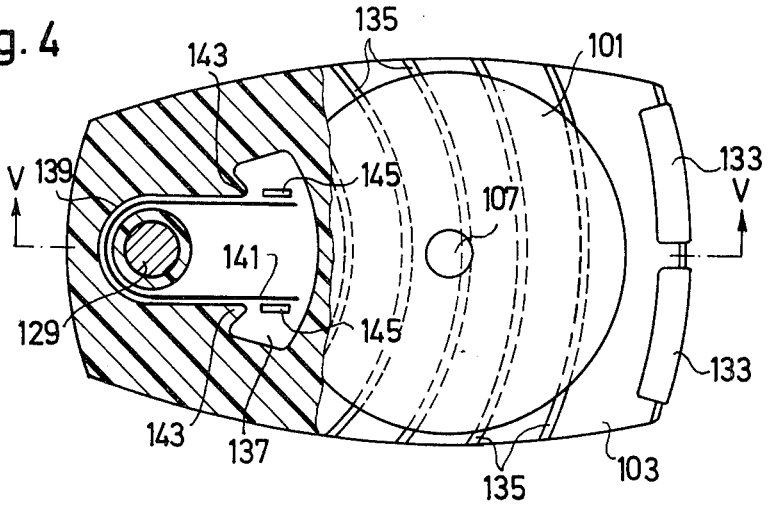
FIG. 4 is a plan view, with parts broken away, of safety ski binding apparatus including a pivotal sole support with a snap-button connection in accordance with a second embodiment of the present invention.

FIG. 4 illustrates another embodiment of a sole support installation. Parts corresponding to those of the first embodiment are designated by corresponding reference numerals of the 100 series. A disk 101 is rotatably supported on a plate 103. A riveted connection 129 secures the plate 103 pivotally on a mounting plate 131 as can be seen best from FIG. 5. The plate 103 and the mounting plate 131 have essentially the same elongated shape. Whereas the riveted connection 129 is provided at one end of this elongated shape, the mounting plate 131 is provided at the other end with guide means 133 angularly bent U-shaped and permitting only a pivot movement of the plate 103. For purposes of reducing the friction between the disk 101 and the mounting plate 131, the plate 103 is provided on its top and bottom side with sliding webs 135 which extend concentrically to the pivot axis of the rivet connection 129 and to the pivot axis of the snap-button connection 107 fastening the disk 101, respectively. An aperture 137 is provided in the plate 103 into which is inserted a U-shaped spring 141 extending in an annular groove 139 about the riveted connection 129. If the plate 103 is pivoted out of its position coincidental with the mounting plate 131, then the spring 141 presses the plate 103 again back into its original position by way of a nose portion of the plate 103 projecting into the aperture 137 in that the spring 141 is supported by an abutment 145.

Figure 6:
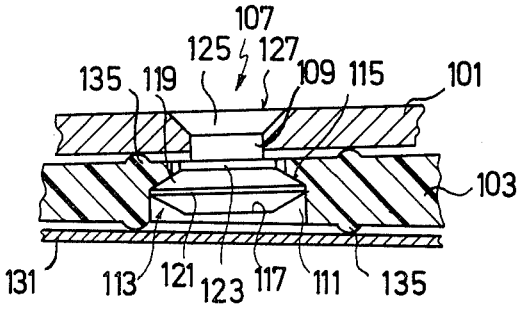
FIG. 6 is a partial cross-sectional view, on an enlarged scale, illustrating some details of FIG. 5.

Details of the snap-button connection 107 illustrated in FIG. 6 can be readily understood in view of the analogous use of reference numerals of the 100 series by comparison with the embodiment of FIG. 3.

Figure 7:
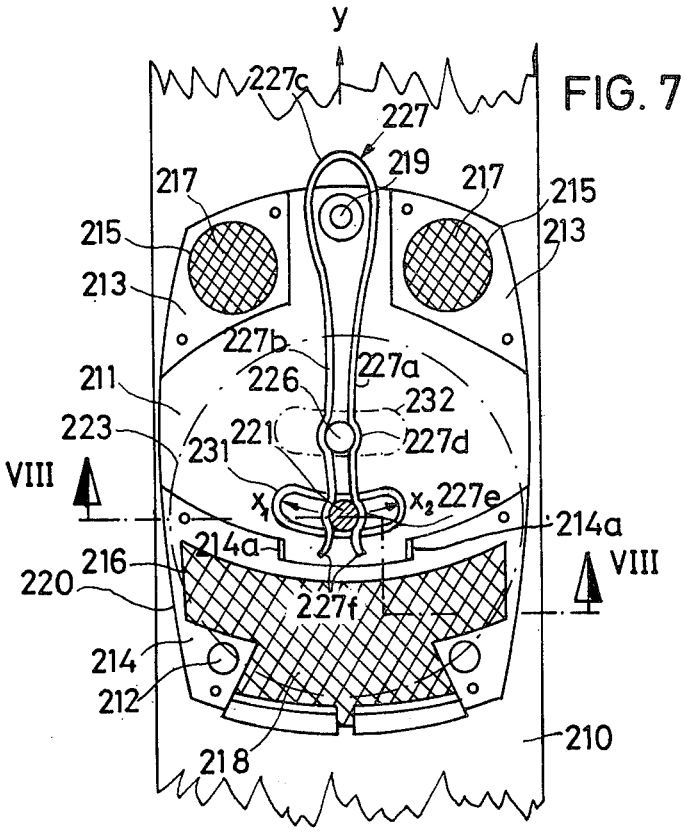
FIG. 7 is a plan view of a still further modified embodiment in accordance with the present invention, in cross section taken along line VII—VII of FIG. 8, wherein the cut-away pivotal sole plate and rotatable disk are indicated only in dash and dot lines.
Figure 8:
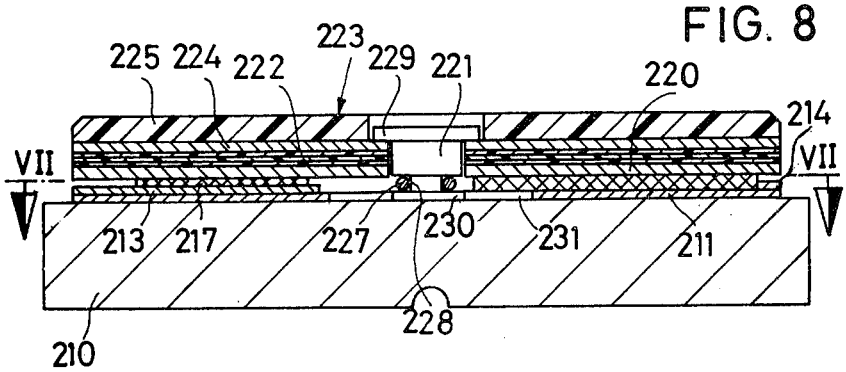
FIG. 8 is a cross-sectional view taken along line VIII—VIII of FIG. 7, this figure being shown at an enlarged scale of 2 to 1 with respect to FIG. 7.
Figure 9:
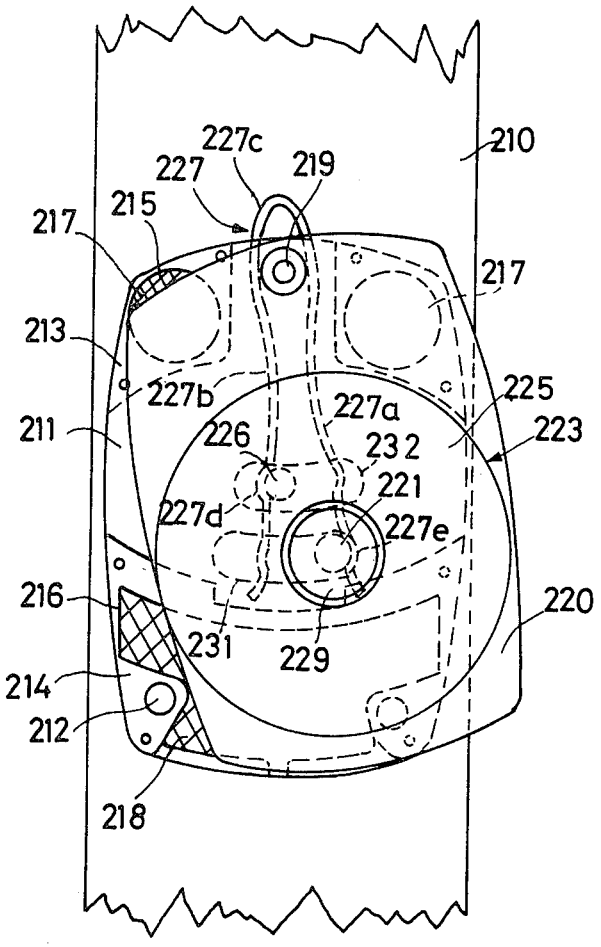
FIG. 9 is a plan view corresponding to FIG. 7, wherein the sole plate and rotatable disk are shown in this figure and the sole plate is deflected.

In FIGS. 7 to 9, a bottom plate 211 is secured on the ski 210, for example, by means of screws 212. Individual retaining plates 213 and 214 which are connected with the bottom plate 211, for example, by spot welding, are provided with apertures 215 and 216 into which are inserted low friction plates 217 and 218 corresponding in their contours to the apertures, which low friction plates 217 and 218 project upwardly beyond the retaining plates 213 and 214. The low friction plates are commercially available copper-plated sheet-metal plates having a porous surface consisting of tin and bronze which is sintered galvanically, into which is embedded Teflon (polytetrafluoroethylene) and lead.

A pivotal sole plate 220 is pivotally secured between the two disk-shaped low friction plates 217 by means of a pivot pin 219 fixed to the ski. A rotatable disk 223 forming the sole support means, is rotatably supported on the sole plate 220 in turn by means of a pivot pin 221 under interposition of disks 222 of a low friction material, for example, Teflon. In the illustrated embodiment of FIGS. 7 to 9, the rotatable disk generally designated by reference numeral 223 consists of a lower metal disk 224 and of an upper plastic material disk 225 of any suitable, known synthetic resinous material, rigidly connected with the metal disk 224.

A further pin 226 fixed to the ski or a corresponding abutment is arranged intermediate the pivot pin 219 and the pivot pin 221 of the rotatable disk 223 in the center longitudinal plane of the ski or near the same. A U-shaped spring 227 is placed in prestressed condition about the pins 219, 226 and 221 and which with its rearward loop-shaped portion 227*c* which connects the two leg portions 227*a* and 227*b*, surrounds the pivot pin 219 with a spacing toward the outside and engages on both sides the further pin 226 fixed to the ski and the pivot pin 221 of the rotatable disk 223 on both sides by means of lateral bent-out portions 227*d* and 227*e*. The U-spring 227 is thereby accommodated in the intermediate space which is formed by the low friction plates between the bottom plate 211 and the pivotal sole plate 220, and engages in an annular groove 228 at the pivot pin 221 and is secured against a lifting out in the upward direction by means of a shoulder or collar 229, engaging over the metallic disk 224 of the rotatable disk 223.

The pivot pin 221 is guided in an arcuately shaped slot 231 by means of a lower collar 230 and limits thereby the angular deflection of the pivotal sole plate 220 during the pivotal deflection thereof about the pivot pin 219 in the direction of arrow $x_1$ or $x_2$. The ends 227*f* of the spring 227 may also be used for limiting the pivot stroke of the sole plate 220 in that these ends 227*f* abut after a predetermined stroke, for example, against projections 214*a* of the retaining plates 214, which are formed by bent-off plate portions.

In FIG. 7, the sole plate 220 together with the rotatable disk 223 are in the normal center position thereof. The sole plate 220 is retained in this position by the U-spring 227 which is supported with prestress, on the one hand, at the pivot pin 219 and, on the other, at the further fixed pin 226 fixedly mounted with respect to the ski. The pivot pin 221 connecting the sole plate 220 and the rotatable disk 223 is thereby retained in the center position by means of the leg portions 227*a* and 227*b* thereof and the lateral bent-out portions 227*e*.

If, for example, as a result of a twisting fall, a lateral force occurs which seeks to deflect the pivotal sole plate 220 in the direction of arrow $x_2$, then this can take place against the return effect of the spring 227 in that the pivot pin 221 deflects the leg portion 227*a* in the direction of arrow $x_1$ by means of the associated bent-out portion 227*e* as is indicated in FIG. 9 in the right end position of the pin 221 limited by the arcuately shaped slot 231. The other leg portion 227*b* thereby remains supported by the pin 226 fixed to the ski. The rotatable disk 223 is thereby able to rotate on the sole plate 220 together with the boot sole about its pivot pin 221 corresponding to the lateral deflection or pivoting movement of the boot. If the pressure of the boot on the rotatable disk 223 and therewith on the deflected sole plate 220 ceases, then the deflected leg portion 227*a* of the U-spring 227 forces the pivot pin 221 and therewith the sole plate 220 again back into the center position illustrated in FIG. 7.

If the rotatable disk 223 is to be lifted out, then this can take place in that the U-spring 227 is pulled forwardly in the direction of arrow *y* by means of its forward loop-shaped end 227*c* whereby the spring expands over the pins 226 and 221 and releases the pivot pin 221, for example, until the bent-out portion 227*e* engages the pin 226 fixed at the ski. The pivot pin 221 is thereby freed in the upward direction and the rotatable disk 223 can be freely removed in the upward direction together with the pin 221. As a result of a further retraction of the spring or also by a complete removal thereof, it is additionally possible to deflect the sole plate 220 completely through 360°. Also, the rotatable disk 223 and the sole plate 220 as well as also the parts disposed therebelow, especially all sliding portions of the installation, are all freely accessible so that they can be cleaned on all sides. This possibility of disassembly of the rotatable disk has significance also without the return function of the spring and the deflection possibility of the sole plate.

The pin 226 fixed on the ski is arranged underneath the sole plate 220 preferably covered by the latter on the base plate 211, but may also possibly extend through the sole plate 220 in an aperture 232, for example, in a slot-like aperture 232 in such a manner that the sole plate 220 is not impaired within its pivot range by the fixed pin 226 in its deflection action.

Also, the parts of the installation disposed underneath the sole plate, for example, the low friction plates 217 and 218, are freely accessible by disengagement of the sole plate 220 at the pivot pin 219 and by removal of the pivot pin or preferably by removal of the spring 227 so that also these parts can be exchanged if desired.

The present invention is not limited in its application to a forward sole plate on which rests the forward portion of the boot but is applicable equally for any other pivotal sole plate, for example, for a heel plate arranged below the heel portion of the boot.

In lieu of a U-spring, any other suitable spring, constructed in any appropriate manner may be provided insofar as it can be incorporated into the construction of the pivotal sole plate and/or the plate aggregates in an appropriate manner. For example, in lieu of the U-shaped spring, two correspondingly clamped leaf springs may be provided or two pressure or tension springs possibly also rubber springs may be provided which retain the pivot pin 221 in the center position thereof and/or return the same into the center position again during deflection of the sole plate.

The present invention is also applicable to a sole plate without rotatable disk in that, for example, the pivot pin 221 for a rotatable disk is replaced by a pin or projection arranged on the pivotal sole plate 220 for the support of the spring 227 or a corresponding different spring.

In preferred embodiments, the rotatable disk is constructed of a low friction material or one or both sides of the rotatable disk are coated with a low friction material.

While I have shown and described several embodiments in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

What I claim is:

1. Ski binding apparatus comprising:

sole support means, and sole support securing means for securing said sole support means to a ski with said sole support means being pivotal about a pivot axis extending approximately perpendicularly to the ski surface, said sole support securing means including non-threaded readily detachable means for accommodating simple manual detachment of said sole support means from a ski, whereby said sole support means can be manually detached from and attached to a ski without use of any tools, in which the sole support means includes a rotatable disk and is rotatably supported on a sole plate means which, in its turn, is pivotally supported on the ski about a pivot axis disposed substantially perpendicularly to the ski surface, wherein the rotatable disk is rotatably secured on the sole plate means against axial lifting off by the readily detachable means.

2. Apparatus according to claim 1, wherein the rotatable disk is rotatably supported on the pivotal sole plate by interposition of at least one layer of low friction material.

3. Apparatus according to claim 2, wherein said material is polytetrafluoroethylene.

4. Ski binding apparatus comprising:

sole support means, and sole support securing means for securing said sole support means to a ski with said sole support means being pivotal about a pivot axis extending approximately perpendicularly to the ski surface, said sole support securing means including non-threaded readily detachable means for accommodating simple manual detachment of said sole support means from a ski, whereby said sole support means can be manually detached from and attached to a ski without use of any tools, in which the sole support means is constructed as rotatable disk and is supported rotatably on a sole plate means, wherein the sole plate means together with the rotatable disk is secured against axial lifting off by the readily detachable means.

5. Apparatus according to claim 4, wherein said rotatable disk consists of a low friction material.

6. Apparatus according to claim 4, wherein the rotatable disk is coated on at least one side with a low friction material.

7. Apparatus according to claim 4, wherein the rotatable disk is coated on both sides with a low friction material.

8. Apparatus according to claim 4, wherein said detachable means includes means for accommodating movement of said sole plate means solely along said pivot axis from an in use operative position to a detached position.

9. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein the sole support means is constructed as a rotatable disk supported rotatably on a sole plate means, wherein the sole plate means together with the rotatable disk is secured against axial lifting off by the readily detachable means, and wherein an insertion element is provided as said readily detachable means, said insertion element being insertable approximately parallel to the ski plane into an aperture of a pivot member defining the pivot axis of the sole support means.

10. Apparatus according to claim 9, wherein the insert element is a spring element.

11. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein the sole support means includes a rotatable disk rotatably supported on a sole plate means, said sole plate means being pivotally supported on the ski about a pivot axis disposed substantially perpendicularly to the ski surface, wherein the rotatable disk is rotatably secured on the sole plate means against axial lifting off by the readily detachable means, and wherein an insert element is provided as said readily detachable means, said insert element insertable into an aperture of the pivot member defining the pivot axis of the sole support means approximately parallel to the ski plane.

12. Apparatus according to claim 11, wherein the insert element is a spring element.

13. Ski binding apparatus comprising:

sole support means, and sole support securing means for securing said sole support means to a ski with said sole support means being pivotal about a pivot axis extending approximately perpendicularly to the ski surface, said sole support securing means including non-threaded readily detachable means for accommodating simple manual detachment of said sole support means from a ski, whereby said sole support means can be manually detached from and attached to a ski without use of any tools, wherein the sole support means includes a rotatable disk and is rotatably supported on a sole plate means, wherein sole plate mounting means are provided for supporting said sole plate means on said ski in such a manner that said sole plate means is movable from a center position to respective laterally deflected positions, and wherein a return spring means is provided which exerts a spring force on said sole plate means when said sole plate means is in a laterally deflected position for returning the sole plate means into the center position.

14. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein the sole support means includes a rotatable disk and is rotatably supported on a sole plate means, wherein sole plate mounting means are provided for supporting said sole plate means on said ski in such a manner that said sole plate means is movable from a center position to respective laterally deflected positions, wherein a return spring means is provided which exerts a spring force on said sole plate means when said sole plate means is in a laterally deflected position for returning the sole plate means into the center position, and wherein an insertion element is provided as said readily detachable means, said insertion element being insertable into an aperture of a pivot member defining the pivot axis of the sole support means.

15. Apparatus according to claim 14, wherein the insertion element is a spring element.

16. Apparatus according to claim 15, wherein the spring element constructed as insertion element simultaneously is the return spring for returning the sole support means into the center position.

17. Apparatus according to claim 16, in which the sole plate means is connected with the rotatable disk by a pivot member, wherein the return spring engages the pivot member.

18. Apparatus according to claim 17, wherein the pivot member is a pivot pin.

19. Apparatus according to claim 18, wherein the return spring engages a pivot member connecting the sole plate means with the rotatable disk.

20. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein the sole support means includes a rotatable disk and is rotatably supported on a sole plate means, wherein sole plate mounting means are provided for supporting said sole plate means on said ski in such a manner that said sole plate means is movable from a center position to respective laterally deflected positions, wherein a return spring means is provided which exerts a spring force on said sole plate means when said sole plate means is in a laterally deflected position for returning the sole plate means into the center position, and wherein the return spring simultaneously is a spring element constructed as an insertion element forming the readily detachable means.

21. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein the sole support means includes a rotatable disk and is rotatably supported on a sole plate means, wherein sole plate mounting means are provided for supporting said sole plate means on said ski in such a manner that said sole plate means is movable from a center position to respective laterally deflected positions, wherein a return spring means is provided which exerts a spring force on said sole plate means when said sole plate means is in a laterally deflected position for returning the sole plate means into the center position, and wherein the return spring is formed by a U-shaped spring fixed at the ski whose free leg portions are operatively connected with the sole plate means.

22. Apparatus according to claim 21, wherein the U-shaped spring is supported with prestress on the pivot pin of the sole plate means and on a further pin fixed with respect to the ski.

23. Apparatus according to claim 22, wherein the return spring engages both of said pins on both lateral sides thereof.

24. Apparatus according to claim 23, wherein said further pin is arranged intermediate the pivot pin of the sole plate means and the pivot pin of the rotatable disk.

25. Apparatus according to claim 24, wherein the pivot stroke of the sole plate means is limited by a slot in a bottom plate fixed to the ski and carrying the pivot pin of the sole plate means, said slot being operable as abutment for the pivot pin of the rotatable disk.

26. Apparatus according to claim 25, wherein said slot is arcuately shaped.

27. Apparatus according to claim 25, wherein the pivot stroke of the sole support means and of the sole plate means is limited by abutment means cooperating with the spring ends.

28. Apparatus according to claim 22, wherein the pivot stroke of the sole plate means is limited by a slot in a bottom plate fixed with respect to the ski and carrying the pivot pin of the sole plate means, said slot forming an abutment for the pivot pin of the rotatable disk.

29. Apparatus according to claim 22, wherein the pivot stroke of the sole support means and of the sole plate means is limited by abutment means cooperating with the spring ends.

30. Ski binding apparatus comprising:

sole support means, and sole support securing means for securing said sole support means to a ski with said sole support means being pivotal about a pivot axis extending approximately perpendicularly to the ski surface, said sole support securing means including non-threaded readily detachable means for accommodating simple manual detachment of said sole support means from a ski, whereby said sole support means can be manually detached from and attached to a ski without use of any tools, wherein sole plate means are interposed between said sole support means and said ski, wherein at least one of the pivotal sole support means and sole plate means is slidingly supported on one of the ski and a bottom plate fixed to the ski by interposition of a low friction layer, and wherein a return spring means is arranged in an aperture of the low friction layer for applying a spring force tending to return at least one of said sole plate means and said sole support means to a center position.

31. Apparatus according to claim 30, wherein said return spring means includes means for resiliently retaining said sole support means in a central non-pivoted position.

32. Apparatus according to claim 31, wherein the low friction layer is constituted by low friction laminated metal plates having low friction material embedded therein.

33. Apparatus according to claim 30, wherein the low friction plates are inserted as individual disks into corresponding apertures of at least one of the two parts consisting of bottom plate and retaining plate means rigidly secured thereto, said low friction plates projecting beyond said one part in the upward direction.

34. Ski binding apparatus comprising:

sole support means, and sole support securing means for securing said sole support means to a ski with said sole support means being pivotal about a pivot axis extending approximately perpendicularly to the ski surface, said sole support securing means including readily detachable means for accommodating simple detachment of said sole support means from a ski, wherein sole plate means are interposed between said sole support means and said ski, wherein at least one of the pivotal sole support means and sole plate means is slidingly supported on one of the ski and a bottom plate fixed to the ski by interposition of a low friction layer, wherein a return spring means is arranged in an aperture of the low friction layer for applying a spring force tending to return at least one of said sole plate means and said sole support means to a center position, wherein said return spring means includes means for resiliently retaining said sole support means in a central non-pivoted position, and wherein the low friction layer is inserted into corresponding apertures of at least one of two parts consisting of the bottom plate and retaining plates fixed to the bottom plate, said low friction layer projecting from said one part in the upward direction.

35. Ski binding apparatus comprising:

sole support means including an upper surface directly engageable with a lower surface of a ski boot, a sole plate attachable to an upper surface of a ski intermediate the ski and said sole support means, a pivot member for pivotally connecting said sole plate to said upper surface of said ski, for rotation about a vertical pivot axis, connecting means for connecting said sole plate to said sole support means for movement therewith, abutment means spaced from said pivot member and projecting vertically from the plane of the sole plate, and a return spring supported at said ski and engaging with said abutment means for applying return forces to said sole plate whenever said sole plate is moved from a central position thereof, said return spring being further supported on said pivot member.

36. Apparatus according to claim 35, wherein said return spring is a U-shaped spring including leg portions engaged at respective opposite sides of both said pivot member and said abutment means.

37. Ski binding comprising:

a pivot plate, a disk, first mounting means for mounting said disk to one of the pivot plate and a ski with the disk being rotatable relatively to said one of the pivot plate and ski about a first axis, second mounting means for mounting said pivot plate to one of said ski and said disk with the pivot plate being pivotal relatively to said one of said ski and said disk about a second axis, one of said pivot plate and said disk including an upwardly facing support surface, abutment means on said pivot plate, and resilient return means engageable with said abutment means for applying forces tending to return said pivot plate to a central position, wherein said resilient return means is engageable with a pin forming said first mounting means, which pin rotatably supports said disk, said pin serving as said abutment means.

38. Apparatus according to claim 37, wherein the one of said sole plate and said disk including an upwardly facing support surface consists of a low friction material.

39. Apparatus according to claim 37, one of said pivot plate and said disk including an upwardly facing support surface is coated at least on one side with a low friction material.

40. Apparatus according to claim 37, wherein the one of said pivot plate and said disk including an upwardly facing support surface is coated on both sides with a low friction material.

41. Ski binding according to claim 37, wherein said resilient return means is engageable with both of said first and second mounting means.

42. Ski binding according to claim 37, wherein said resilient return means is engageable with said second mounting means.

43. Ski binding according to claim 37, wherein said first mounting means mounts said disk to said pivot plate and said second mounting means mounts said pivot plate to said ski with said support surface being on said disk.

44. Ski binding according to claim 43, wherein said resilient return means is engageable with both of said first and second mounting means.

45. Ski binding according to claim 44, wherein said first mounting means is constructed as a pivot pin for the rotatable mounting of the disk on the pivot plate.

46. Ski binding according to claim 43, wherein said resilient return means is engageable with said second mounting means.

47. Ski binding according to claim 37, wherein said first and second axes extend substantially vertically with respect to said ski.

48. Ski binding comprising:

a pivot plate, a disk, first mounting means for mounting said disk to one of the pivot plate and a ski with the disk being rotatable relatively to said one of the pivot plate and ski about a first axis, second mounting means for mounting said pivot plate to one of said ski and said disk with the pivot plate being pivotal relatively to said one of said ski and said disk about a second axis, one of said pivot plate and said disk including an upwardly facing support surface, abutment means on said pivot plate, and resilient return means engageable with said abutment means for applying forces tending to return said pivot plate to a central position, wherein said resilient return means is engageable with at least one of said first and second mounting means, wherein said first mounting means mounts said disk to said pivot plate and said second mounting means mounts said pivot plate to said ski with said support surface being on said disk, wherein said resilient return means is engageable with both of said first and second mounting means with said first mounting means serving as said abutment means, and wherein said resilient return means is a spring means having a portion supported at said second mounting means and having two arms which contact respective opposite sides of said first mounting means such that, upon a pivoting of the pivot plate laterally away from said central position, a respective one of the two arms is tensionally engaged with said first mounting means.

49. Ski binding according to claim 48, wherein said first mounting means is constructed as a pivot pin for the rotatable mounting of the disk on the pivot plate.

50. Ski binding according to claim 48, wherein said spring means is a U-shaped spring element with said two arms being connected by a central bridging portion, said central bridging portion being engageable with and supported on the pivot pin forming said second mounting means, and wherein an upwardly directed projecting means is arranged on the ski, said arms engaging respective opposite lateral sides of said projecting means when said pivot plate is in said central position such that, when one of said arms is moved laterally upon displacement of said pivot plate, the other of said arms is maintained in position by said projecting means and said pivot pin forming said second mounting means.

51. Ski binding comprising:

a pivot plate, mounting pin means for mounting said pivot plate to said ski with the pivot plate being pivotal relatively to said ski about an axis through said mounting pin means, said pivot plate having an upwardly facing support surface, abutment means on said pivot plate, and resilient return means engageable with said abutment means for applying forces tending to return said pivot plate to a central position, wherein said resilient return means is engageable with and supported on said mounting pin means.

52. Ski binding according to claim 51, wherein said resilient return means is a spring means having a portion supported at said mounting pin means and having two arms which contact respective opposite lateral sides of said abutment means such that, upon a pivoting of the pivot plate laterally away from said central position, a respective one of the two arms is tensionally engaged with said abutment means.

53. Ski binding comprising:

a pivot plate, mounting means for mounting said pivot plate to said ski with the pivot plate being pivotal relatively to said ski about an axis, said pivot plate having an upwardly facing support surface, abutment means on said pivot plate, and resilient return means engageable with said abutment means for supplying forces tending to return said pivot plate to a central position, wherein said resilient return means is engageable with and supported on said mounting means, wherein said resilient return means is a spring means having a portion supported at said mounting means and having two arms which contact respective opposite lateral sides of said abutment means such that, upon a pivoting of the pivot plate platerally away from said central position, a respective one of the two arms is tensionally engaged with said abutment means, and wherein said spring means is a U-shaped spring element with said two arms being connected by a central bridging portion, said central bridging portion being engageable with and supported on a pivot pin forming said mounting means, and wherein an upwardly directed projecting means is arranged a the ski, said arms engaging respective opposite lateral sides of said projecting means when said pivot plate is in said central position such that when one of said arms is moved laterally upon displacement of said pivot plate, the other of said arms is maintained in position by said projecting means and said pivot means forming said mounting means.

54. Apparatus according to claim 1, wherein said readily detachable means includes a two-part snap-action connection means having a first part fixedly connectible to said sole plate means and a second part fixedly connectible to said rotatable disk, said first and second parts including respective interengageable locking surface portions which effect automatic locking of said two parts to one another in response to forcing of said two parts toward one another by first predetermined forces acting in the direction of said pivot axis and which effect automatic unlocking of said two parts from one another in response to forcing of said two parts away from one another by second predetermined forces acting in the direction of said pivot axis, whereby said rotatable disk can be readily manually attached to and detached from said sole plate means by applying axial forces at said two parts.

55. Apparatus according to claim 54, wherein said second part is a bolt fixedly secured to said rotatable disk and extending along said pivot axis, said sole plate means including an aperture alignable with said pivot axis for accommodating a lower portion of said bolt, said bolt including an enlarged snap-button head portion at the botton end thereof, said snap-button head portion including upwardly facing surfaces which constitute the interengageable locking surface portions of said second part and which engage with an undercut portion on said sole plate means adjacent said aperture which constitute the interengageable locking surface portions of said first part.

56. Apparatus according to claim 55, wherein one of said snap-button head portion and the area of said sole plate means surrounding said aperture is constructed of tenaciously elastic material which elastically deforms to permit locking and unlocking of said two parts with respect to one another.

57. Apparatus according to claim 56, wherein said sole plate means is constructed of said tenaciously elastic material.

58. Apparatus according to claim 56, wherein said elastic material is one of hard rubber and synthetic resinous materials, especially polyamides.

59. Apparatus according to claim 56, wherein the snap-button head portion to be forced into the aperture includes two conical sections substantially coaxial to the axis of the bolt and diverging with respect to one another between which is disposed a cylindrical section.

60. Apparatus according to claim 54, wherein the angle of undercut of the aperture is substantially equal to the cone angle of the conical section to be overlapped by the undercut.

61. Apparatus according to claim 56, wherein said rotatable disk is attached to said sole plate means exclusively by the single snap-action connection formed between the bolt and the undercut portion of the aperture.

* * * * *